US010595569B2

(12) United States Patent
Oguchi et al.

(10) Patent No.: US 10,595,569 B2
(45) Date of Patent: Mar. 24, 2020

(54) CLOTHING

(71) Applicants: Japanese Foundation for Cancer Research, Tokyo (JP); Toray Industries, Inc., Tokyo (JP)

(72) Inventors: Masahiko Oguchi, Tokyo (JP); Shiho Goto, Tokyo (JP); Emiko Ishikawa, Osaka (JP); Shinya Komori, Otsu (JP); Yukari Hattori, Tokyo (JP); Shou Miyazaki, Tokyo (JP)

(73) Assignees: Japanese Foundation For Cancer Research, Tokyo (JP); Toray Industries, Inc., Tokyo (JP)

( * ) Notice: Subject to any disclaimer, the term of this patent is extended or adjusted under 35 U.S.C. 154(b) by 0 days.

(21) Appl. No.: 15/323,901

(22) PCT Filed: Jul. 3, 2015

(86) PCT No.: PCT/JP2015/069236
§ 371 (c)(1),
(2) Date: Jan. 4, 2017

(87) PCT Pub. No.: WO2016/006541
PCT Pub. Date: Jan. 14, 2016

(65) Prior Publication Data

US 2017/0143049 A1 May 25, 2017

(30) Foreign Application Priority Data

Jul. 9, 2014 (JP) ..... 2014-141337

(51) Int. Cl.
*A41C 3/00* (2006.01)
*A41C 3/08* (2006.01)
(Continued)

(52) U.S. Cl.
CPC ..... *A41C 3/0064* (2013.01); *A41C 3/0035* (2013.01); *A41C 3/02* (2013.01);
(Continued)

(58) Field of Classification Search
CPC ..... A41C 3/0064; A41C 3/0035
(Continued)

(56) References Cited

U.S. PATENT DOCUMENTS 5,611,086 A * 3/1997 Eggen ..... A41D 1/205 2/102
5,946,726 A * 9/1999 Green ..... A41C 3/0057 2/102
(Continued)

FOREIGN PATENT DOCUMENTS

EP 1 266 990 12/2002
JP 2533290 Y2 4/1997
(Continued)

OTHER PUBLICATIONS

Supplementary European Search Report dated Dec. 7, 2017, of corresponding European Application No. 15818199.0.

*Primary Examiner* — Alissa J Tompkins
*Assistant Examiner* — Brieanna Szafran
(74) *Attorney, Agent, or Firm* — DLA Piper LLP (US)

(57) ABSTRACT

Clothing uses a knitted fabric made from a composite thread of elastic fibers and synthetic fibers, wherein the elongation rates in the longitudinal and lateral directions as measured in accordance with the grab method of JIS-L-1096 are 160% or more and less than 250%, and the weight per unit area is 90 g/m2 or more and less than 160 g/m2. The clothing is suitable for use by patients having skin inflammations, has a comfortable texture using a knitted fabric that is light and has a high elongation rate, and does not allow seepage of medicaments or infusions.

12 Claims, 3 Drawing Sheets

(51) Int. Cl.

| | |
|---|---|
| ***D04B 1/18*** | (2006.01) |
| ***D04B 1/24*** | (2006.01) |
| ***A41D 13/12*** | (2006.01) |
| ***A41C 3/02*** | (2006.01) |
| ***A41C 3/14*** | (2006.01) |
| ***A41D 31/30*** | (2019.01) |

(52) U.S. Cl.
CPC ..... *A41C 3/08* (2013.01); *A41C 3/144* (2013.01); *A41D 13/1245* (2013.01); *D04B 1/18* (2013.01); *D04B 1/24* (2013.01); *A41B 2400/34* (2013.01); *A41B 2400/36* (2013.01); *A41B 2500/10* (2013.01); *A41D 31/30* (2019.02); *D10B 2509/02* (2013.01)

(58) Field of Classification Search
USPC ..... 450/30–35
See application file for complete search history.

(56) References Cited

U.S. PATENT DOCUMENTS

| | | | | |
|---|---|---|---|---|
| 6,059,633 | A * | 5/2000 | Currier | A41C 3/02 450/10 |
| 6,572,437 | B1 | 6/2003 | Waitz | |
| 8,403,724 | B1 | 3/2013 | Chapin | |
| 2003/0077961 | A1* | 4/2003 | Cates | D06P 5/30 442/59 |
| 2006/0223415 | A1* | 10/2006 | Watrin | A41C 3/0014 450/39 |
| 2007/0004314 | A1 | 1/2007 | Carlucci | |
| 2009/0259159 | A1* | 10/2009 | Bell | A41C 3/0064 602/75 |
| 2010/0319409 | A1 | 12/2010 | Soeda | |
| 2012/0244773 | A1* | 9/2012 | Akita | D04B 21/18 442/306 |
| 2015/0079876 | A1* | 3/2015 | Betts | A41C 3/0057 450/78 |
| 2016/0015090 | A1* | 1/2016 | Mazourik | A41C 3/0028 450/39 |

FOREIGN PATENT DOCUMENTS

| | | | |
|---|---|---|---|
| JP | 10-317281 | A | 12/1998 |
| JP | 3064936 | B2 | 7/2000 |
| JP | 2001-355103 | A | 12/2001 |
| JP | 2003-13347 | A | 1/2003 |
| JP | 2004-11077 | A | 1/2004 |
| JP | 2005-089909 | | 4/2005 |
| JP | 2007-332520 | A | 12/2007 |
| JP | 2009-24278 | A | 2/2009 |
| JP | 2009-209495 | | 9/2009 |
| JP | 4507574 | B2 | 7/2010 |
| JP | 2013-155463 | A | 8/2013 |
| JP | 2013-231263 | A | 11/2013 |

* cited by examiner

CLOTHING

TECHNICAL FIELD

This disclosure relates to clothing having a comfortable texture and which is excellent in wear comfort.

BACKGROUND

As typical methods in disease treatments, surgical therapy, pharmaceutical therapy and radiation therapy can be exemplified. Although these methods are very effective for treatment it is required to take sufficient care also of complications or side effects caused in such treatment process. While medical technology in such disease treatments progresses, with respect to progress of environmental improvement in how patients can comfortably receive treatments, because there are few opportunities to obtain first-hand information of medical practice, problems remain.

As one example, clothing for a patient needing treatment can be raised. For progress of medical technology with respect to clothing for providing comfort to a patient during disease treatment or after treatment, progress is almost not found. Namely, as clothing for a patient requiring treatment worn at the time of the treatment, nightclothes or inner wear such as an underwear or a brassiere, which are generally sold, are frequently worn as usual. Although inner wears are brought into contact directly or indirectly with skin damaged with the above mentioned disease treatments, clothing for general use is not made into products particularly in consideration of medical hygiene or convenience and, therefore, sometimes they are disadvantageous for medical use. For example, in a sewing section, because fabric is sewn by a thread, it cannot be avoided to cause a linear projection, and only at a condition where this section touches an inflamed skin part, a scratching of the skin, a stimulation of the epidermis or the like is sometimes caused, and this section sometimes becomes a cause worsening inflammation. Further, for a part causing an inflammation on the skin or becoming fragile by a disease or a disease treatment, the affected part is frequently protected by being newly applied with a gauze or a lint, but clothing for general use, which can adequately hold such a medical material coated with a medicament, almost does not exist and, therefore, a patient is forced to experience high inconvenience.

Due to such a lack of clothing for the time during disease treatment, quality of cure or quality of life of a patient may be reduced by caused inflammation or rash of a wounded part after operation, or risk of infection, or further, discomfort of a patient and, as a result, sometimes a curative effect is also reduced.

For example, in breast cancer, its disease prevalence tends to increase year after year, and as treatments therefor, surgical therapy, pharmaceutical therapy such as chemotherapy and radiation therapy are effective treatments, and to suppress relapse of breast cancer, radiation therapy after a breast conserving surgery or mastectomy is greatly effective. However, because radiation induced dermatitis of an irradiated part is an inevitable side effect and it is caused relatively broadly, as a measure therefor, supportive dermatological therapy for a skin inflammation is performed together. The supportive dermatological therapy is performed mainly by applying a skin medication from the time during radiation therapy to a time of about two weeks after the radiation therapy. Concretely, although there are cases that an ointment or the like is applied to the epidermis of a treated part and it is covered with a medical material such as a gauze or a lint and it is fastened by a plaster, that it is wound with an elastic bandage from its outer side, or that a maternity brassiere is worn, in these manners there is a possibility of causing a sore or an itch of the skin. Further, there is also a possibility of soiling outer wear by leakage or seepage of a medicament or a skin infusion from an inflammation part. Thus, because inner wear suitable to protect the skin by holding an ointment does not exist, it is a great obstacle for medical practice.

Since it is not solved by simply combining existing general medical materials, as maternity brassieres, proposed are a maternity brassiere comprising a non-stretchable cup lining and a stretchable outer material (refer to Japanese Utility Model No. 2533290), a front opening maternity brassiere provided with a belt made from a high elastic raw material (refer to JP 3064936 B), a nursing brassiere exposable with left and right breasts at a condition being worn (refer to JP 4507574 B), a brassiere having a non-elastic chest supporting panel (refer to U.S. Pat. No. 6,572,437) and the like. However, in the brassieres described in Japanese Utility Model No. 2533290 and JP 3064936 B, because the cup part lining cloth or the strap part lining cloth are formed from a non-stretchable cloth or a cloth having a small elasticity, they tighten the breasts and the vicinity, thereby giving a great stimulus to the skin, and they obstruct wear comfort. Further, in the brassiere described in JP 4507574 B, because the left and right cup parts are configured at a form capable of exposing the breasts at a condition being worn and it has a holding portion capable of inserting mother's milk breast pads inside the left and right cup parts, seams are overlapped around the breast parts and a structure is formed wherein the difference in level between the pad and the holding portion causes a skin stimulation. Furthermore, in the brassiere described in U.S. Pat. No. 6,572,437, although it is a front opening brassiere made from a stretchable material, because it has a non-elastic chest supporting panel, there is no elongation in that part and there is a possibility of causing skin stimulation.

As described above, with respect to general medical materials and clothing such as brassieres worn at the time of woman's chest disease treatment, it is difficult to say that there exists clothing adequate for protection of an affected part and application for disease treatment and also providing wear comfort to a patient.

It could therefore be helpful to provide clothing improving such defects in the conventional technologies, having a comfortable texture and excellent in wear comfort.

SUMMARY

We thus provide:

a knitted fabric made from a composite thread of elastic fibers and synthetic fibers, wherein elongation rates in longitudinal and lateral directions of the knitted fabric as measured in accordance with the grab method of JIS-L-1096 are 160% or more and less than 250%, and a weight per unit area of the knitted fabric is 90 g/m$^2$ or more and less than 160 g/m$^2$.

It is preferred that the above-described synthetic fibers comprise polyamide-based fibers having a moisture absorption.

The clothing is preferably formed as a front opening brassiere type inner wear.

It is preferred that an under belt located under a position of the breasts of the above-described front opening brassiere type inner wear is made from a same raw material as that of a body part fabric, and a width of the under belt is 5 cm or more and 10 cm or less.

It is preferred that pockets capable of being put in and out of with pads are sewn outside the position of the breasts of the above-described front opening brassiere type inner wear.

It is also preferred that the clothing comprises a combination of a front opening cardigan type outer wear and a front opening brassiere type inner wear. In this case, the front opening cardigan type outer wear and the front opening brassiere type inner wear preferably have a mechanism capable of being sewn to or detached from each other at a shoulder line.

It is preferred that the above-described knitted fabric is treated by water repellent finishing.

When the knitted fabric is treated by water repellent finishing, a structure can be employed wherein a fluorine-based compound is provided on the surface of the knitted fabric. In this case, it is preferred that the fluorine-based compound is a fluorine-based water repellent and oil repellent resin having a hydrophilic component. In that case, it is preferred that the knitted fabric is rank 2 or lower in degree of water repellency and rank 4 or higher in degree of oil repellency.

It is preferred that the clothing has an antibacterial property and/or a deodorant property.

Further, it is preferred that the clothing is clothing used by a patient having a skin inflammation on the chest.

By wearing our clothing, effects can be obtained wherein a part causing an inflammation on the skin or becoming fragile by a treatment, or a wounded part after operation, can be gently overwrapped and, further, it can be provided with a function of holding gauze or lint applied with a medicament such as an ointment and the wear comfort for a patient can be improved. In addition, when the clothing is treated with a soil resistant finishing, an effect can be obtained wherein a medicament applied to a skin affected part or a body fluid seeped by an inflammation does not seep outside an inner wear, there is no risk of soiling an outer wear by an infusion, and an outer wear can be worn at ease.

EXPLANATION OF SYMBOLS

Figure 1:
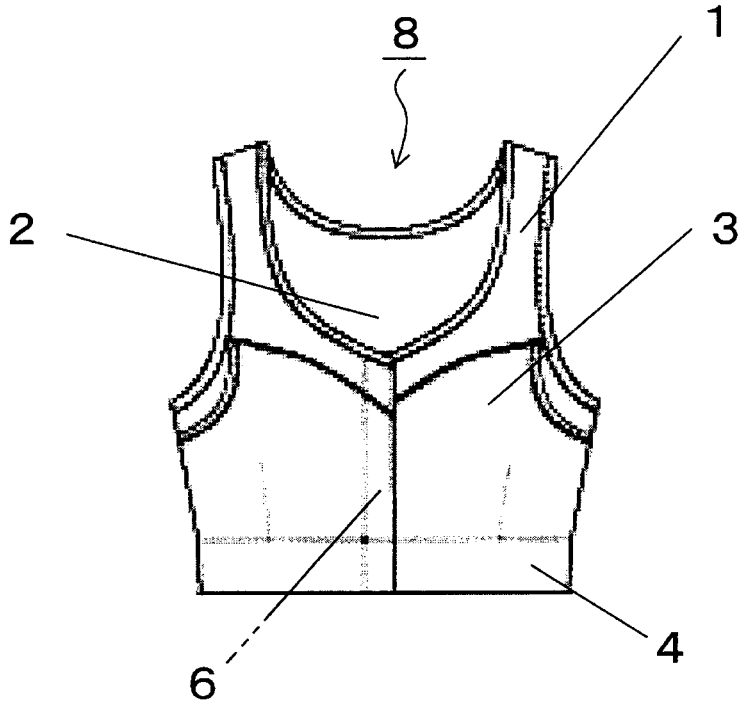
FIG. 1 is a figure showing an example of a front opening brassiere type inner wear of our clothing.

1: front body part of brassiere type inner wear
2: back body part of brassiere type inner wear
3: pocket of brassiere type inner wear
4: under belt of brassiere type inner wear
5: front opening cardigan type outer wear
6: engaging member
7: shoulder line
8: brassiere type inner wear
9: foot cover
10: bottom surface
11: cushion material
12: stomach band
13: seam of stomach band

DETAILED DESCRIPTION

Hereinafter, our clothing will be explained more concretely.

Our clothing satisfies convenience for treatment and necessary conditions for maintaining comfort for a patient. Namely, satisfied are high-performance for treatment and care (in non-stimulation, soil resistance, chemical resistance, elasticity, washing possibility and the like), and function to hold a medical material to protect an affected part and the like.

As a raw material used for our clothing, a raw material low in skin stimulation is selected, and a composite thread of elastic fibers and synthetic fibers is used. As the elastic fibers, a spandex yarn, or a multifilament yarn of composite fibers, formed by laminating two kinds of polyester-based polymers, one of which is a polyester mainly made from polytrimethylene terephthalate (hereinafter, also referred to as "PTT"), in a side-by-side type along a fiber-lengthwise direction, can be used. The synthetic fibers mean polyester-based fibers, polyamide-based fibers, acrylic-based fibers and the like. For example, a formation false-twist worked with polyurethane fibers and nylon fibers, aligned with both kinds of fibers, or used with both kinds of fibers separately for surface and back surface of a knit weave, can be employed.

The side-by-side type composite fibers are made by laminating polymers different in intrinsic viscosity, copolymerization component, copolymerization rate and the like, and exhibit crimps by a difference between the polymers in elastic recovery property or shrinkage property. In side-by-side type composite fibers having a difference in intrinsic viscosity, because a stress is concentrated to the higher intrinsic viscosity-side at the time of stretching, internal strains are different between the two components. Therefore, the higher viscosity side is greatly shrunk by a difference between elastic recovery rates after stretching and a difference between thermal shrinkages at a heat treatment process of a woven fabric, a strain is caused in a single fiber and a formation of a three-dimensional coil crimp is exhibited. The diameter of this coil and the number of coils per a unit fiber length are decided depending upon a difference in shrinkage between the higher shrinkage component and the lower shrinkage component (including a difference between elastic recovery rates), and the greater the difference in shrinkage is, the smaller the coil diameter is, and the number of coils per a unit fiber length becomes greater. As properties with respect to coil crimp required as a stretch raw material, the coil diameter is small, the number of coils per a unit fiber length is great (excellent in elongation property and good in appearance), the settling resistance of the coil is good (small in amount of settling of coil in accordance with times of stretching and excellent in stretch retaining property), further, hysteresis loss at the time of stretching recovery of a coil is small (excellent in elastic-urging property and good in fit feeling.

Elongation rates in longitudinal and lateral directions of the knitted fabric using the above-described composite thread of elastic fibers and synthetic fibers as measured under a condition of 1.5 kg load are 160% or more and less than 250% and, by this, a fitting property to a body can be improved while being low in stimulation.

Such an elongation rate indicates a degree of elongation of the knitted fabric, and although the details of the measuring method will be described later, it is a value measured in accordance with the elongation rate B method (grab method) of JIS-L-1096 "Fabric test method of general woven fabric and knitted fabric" (2014). When the elongation rate is less than 160%, because of tightening of the skin and giving a stimulus to the skin, the wear feeling is poor. Further, at a rate of 250% or more, to the contrary, because the fabric stretches too much and it is hard to be closely contacted to the skin, a gap is caused between a gauze or a lint applied with a medicament such as an ointment and the clothing, the clothing moves along with movement of the body, it causes the gauze or the lint to be dislocated or a stimulus to the skin to be increased and, therefore, the wear feeling is poor.

Moreover, in our clothing, a weight per unit area of the knitted fabric is 90 g/m$^2$ or more and less than 160 g/m$^2$. If the weight per unit area is less than 90 g/m$^2$, the fabric is too light and close contact property thereof is poor. Further, if it is 160 g/m$^2$ or more, because the weight of a product becomes too great, a burden is applied to a shoulder as a weight, and such a condition is not preferred. For the same reasons, a more preferable range of the weight per unit area is 100 g/m$^2$ or more and less than 150 g/m$^2$.

Further, it is preferred that the above-described synthetic fibers of the knitted fabric comprise polyamide fibers having a moisture absorption to satisfy flexibility of the fibers and reduce stuffy wearing conditions.

Hereinafter, examples will be concretely explained referring to the drawings.

Figure 2:
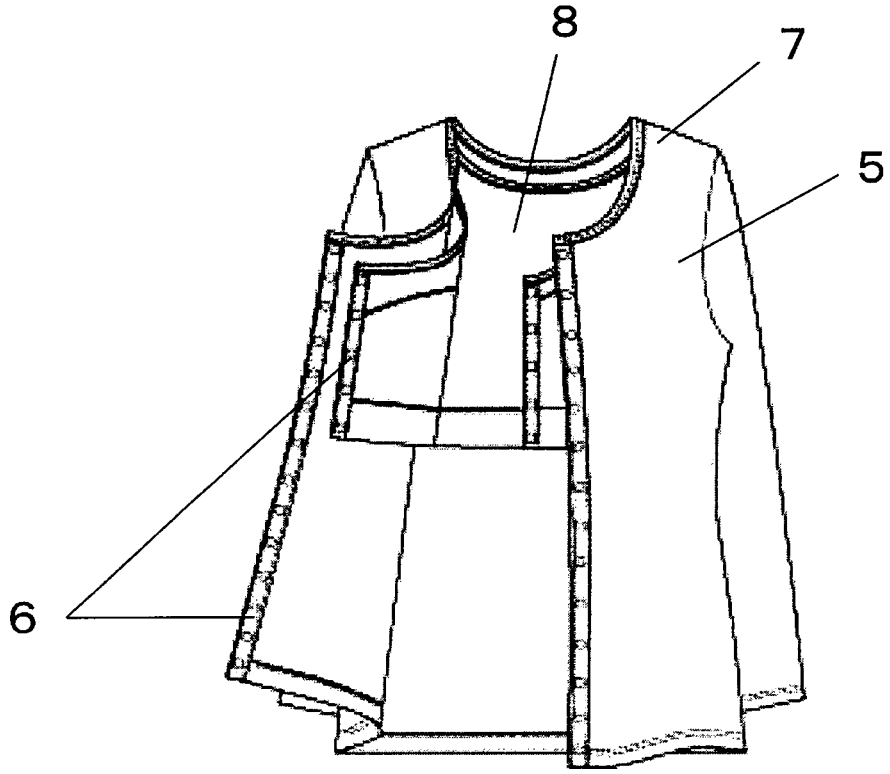
FIG. 2 is a figure showing an example of a combination of a front opening cardigan type outer wear and a front opening brassiere type inner wear of our clothing.
Figure 3:
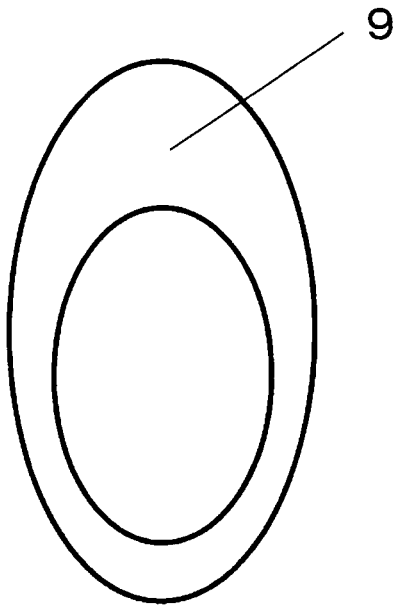
FIG. 3 is a figure viewed from an upper surface of another example of our clothing.
Figure 4:
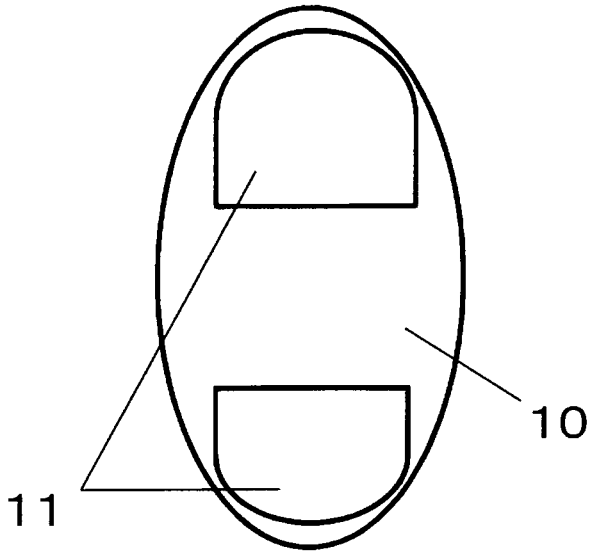
FIG. 4 is a figure viewed from a bottom surface of the example of our clothing shown in FIG. 3.
Figure 5:
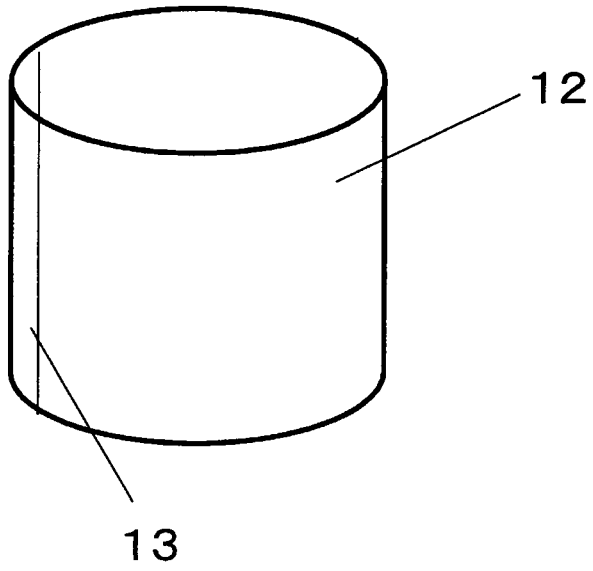
FIG. 5 is a perspective diagram viewed from a front side of a further example of our clothing.

FIG. 1 is a figure viewed from a front body part of an example of a brassiere type inner wear of clothing. FIG. 2 is a figure viewed from a front body part of an example of a combination of a front opening cardigan type outer wear and a brassiere type inner wear of clothing. FIG. 3 is a figure viewed from an upper surface of another example of clothing. FIG. 4 is a figure viewed from a bottom surface of the example shown in FIG. 3. FIG. 5 is a perspective diagram viewed from a front side of a further example of our clothing.

The clothing means a clothing brought into direct contact with skin such as underwear, a night cloth, brassiere, shorts, socks, gloves or stomach band.

For example, as clothing for a patient suffering from breast cancer, as shown in FIG. 1, a front opening brassiere type inner wear 8 comprises a front body part 1 and a back body part 2, and is formed as a front opening type. For the front opening portion, it is necessary to dispose a member to engage left and right parts, and as an engaging member 6, a hook and loop fastener, a coil open fastener, a snap, a dot button, a string, a button, a tape attached with dot buttons and the like can be used. Among these, tape attached with dot buttons is more preferable because the sewing processes are few and an engaging member does not come into direct contact with the skin surface. The tape attached with dot buttons is formed by driving dot buttons into a tape made from a woven or knitted fabric and, when it is sewn, only the tape may be sewn. Further, to avoid stimulus to the skin, a structure may be employed wherein the tape at the lower end of the front body part is set slightly oblique to the end of the fabric or the lower end of the body part is also cut obliquely. A pocket for inserting a pad 3 is sewn outside the front body part, and an under belt 4 is sewn at the lower edge of the body part.

It is preferred that the under belt 4 located under a position of the breasts of the front opening brassiere type inner wear 8 is made from a same raw material as that of the body part fabric, and the width of the under belt 4 is 5 cm or more and 10 cm or less, from the viewpoints of comfortable texture, easy attaching and detaching property, close contact property to the body and supportability of the breasts. More preferably, the width is 6 cm or more and 10 cm or less.

By setting the fabric of the under belt 4 same as the body part fabric, since it is similar to the texture and fittability of the body part fabric and, further, to the functionality such as one for seepage of medicaments, the performance of the whole of the wear can be maintained.

Further, if the width of the under belt 4 is less than 6 cm, there is a possibility that it digs into the skin, stimulates the skin, and the skin becomes red and itchy and, therefore, it is preferable to be as wide as possible. However, if more than 10 cm, it is too wide, and because oppression or hotness is felt, such a condition is not preferred.

Furthermore, by sewing or adhering a stretchable tape to the under belt 4, closer contact to the body becomes possible. The surface for the sewing or the adhering may be any of the skin side and the outside.

It is preferred that pockets 3 capable of being put in and out of with pads are sewn outside the position of the breasts of the above-described brassiere type inner wear 8. In particular, because the weight balance of left and right sides becomes bad after a mastectomy of one of the breasts at the time of the treatment of breast cancer, the size of the pockets 3 for inserting pads is preferably as large as possible to correspond to various sizes of the breasts. Although a product provided with pockets for inserting pads at the inside position is also sold on the market, when the treatment is being performed at a condition where a gauze or a lint is applied to an affected part, it is not preferred because it is difficult to insert pads into the inside pockets or to change the positions of the pads. By attaching the pockets outside, because pads can be moved to required positions even after an inner wear is worn, it is preferred. Although an insertion opening of the pocket may be provided at any portion such as a straight line along an upper edge or an armpit gland, it is preferably provided at a form of a curved line approximately parallel to a sleeve obliquely at a position near the armpit because a pad can be easily put in and out.

Although the raw material of the pads is not particularly restricted, a raw material high in safety for a living body and having a weight as same as possible as that of a remaining one of the breasts is preferably employed from the viewpoint of balance of the left and right sides.

The above-described brassiere type inner wear 8 is preferably used also for, for example, the time for nursing, without limiting the use for disease treatments. In particular, although the size of the breasts during nursing may vary even in an identical person, it is possible to deal with such a state by wearing the brassiere type inner wear.

In the example shown in FIG. 2, the above-described brassiere type inner wear 8 and a front opening cardigan type outer wear 5 are combined, this front opening cardigan type outer wear 5 comprises a front body part, a back body part and left and right sleeves, and an engaging member 6 is sewn to each of left and right ends of the front body part to enable opening and closing. As the engaging member 6, a hook and loop fastener, a coil open fastener, a snap, a dot button, a string, a button, a tape attached with dot buttons and the like can be used, and among these, a tape attached with dot buttons is more preferable similarly to in the brassiere type inner wear.

The front opening cardigan type outer wear 5 and the brassiere type inner wear 8 may be integrated by sewing them at a shoulder line, or it may be possible to sew a belt loop, capable of being opened and closed, to a shoulder line of the cardigan and integrate only at the wearing time by letting the shoulder of the brassiere through the belt loop. In particular, the method of attaching a belt loop is more preferred because of the ability to deal with the time when only the brassiere is required to be exchanged and washed.

Since the knitted fabric used for the above-described clothing has a very comfortable texture, it is also preferred when an inflammation is present on the skin.

Except the above-described wear for a patient suffering from breast cancer, for example, also with respect to socks having a foot cover shape as shown in FIGS. 3 and 4 (symbol 9: foot cover, symbol 10: bottom surface of foot cover, symbol 11: cushion material), a tubular stomach band as shown in FIG. 5 (symbol 12: stomach band, symbol 13: seam of stomach band) and gloves, by employing the above-described fibrous structure having a stretchable function, a skin stimulus can be suppressed as less as possible, and a property for bearing to a long-time wearing can be realized.

For the treatment for skin inflammations, mainly two functions are required except comfortable texture. When an ointment or an external preparation is applied to a skin inflammation part and the skin is covered with a medical material such as a gauze or a lint, because of a high stretchable function, it becomes possible to adequately hold the medical material. As another function, a function of preventing leakage of an applied medicament or seepage of an infusion from a skin inflammation part is required, and by employing the following processing, a satisfactory function can be exhibited.

It is preferred that a fluorine-based compound is fixed to the surfaces of fibers of the knitted fabric and, more desirably, it is preferred that the fluorine-based compound have a hydrophilic component. It is a particularly preferable example to use a resin containing a triazine ring together with the fluorine-based compound to improve washing durability. As the resin containing a triazine ring, melamine resin, guanamine resin, bismaleimide triazine resin and the like can be exemplified, and melamine resin is particularly preferred.

The melamine resin can be selected from various melamine resins from trimethylol melamine to hexamethylol melamine. If a lot of melamine resin is used, although the cross-linking effect is increased, the texture tends to be hardened. From the viewpoint of maintaining a flexible texture while obtaining a sufficient cross-linking effect, it is preferred to provide it with a solid component of 0.01 to 1 wt %, further 0.02 to 0.5 wt %, relative to the total weight of a fibrous structure.

As a curing catalyst for the melamine resin, preferred are inorganic acid salts such as ammonium phosphate, ammonium sulfate, ammonium nitrate, aluminum phosphate, aluminum sulfate, aluminum nitrate, zinc phosphate, zinc sulfate, zinc nitrate, and ammonium formate, ammonium acetate, ammonium acrylate, ammonium succinate, aluminum formate, aluminum acetate, aluminum acrylate, aluminum succinate, zinc formate, zinc acetate, zinc acrylate, zinc succinate and the like.

By the condition where such a fluorine-based compound is fixed to the surfaces of the fibers, an infusion from a wounded part after operation or an oil-based medication applied thereonto or the like is hardly stuck to a skin-side surface of the clothing, and further, seepage thereof to outside can be reduced. To exhibit soil resistance, by optimizing the rate of a hydrophilic component containing oxygen and a water repellent and oil repellent component containing fluorine, it is effective to satisfy both performances of resistance and easy removal of soils. The affinity between the fibers and a liquid for cleaning can be improved by the hydrophilic component, and penetration of soils into the interiors of the fibers can be suppressed by the water repellent and oil repellent component.

To obtain the knitted fabric, a pad-dry-cure method of dipping a knitted, scoured and dyed fabric in a treatment liquid containing a fluorine-based compound and, thereafter, squeezing it at a constant pressure at a state of open width, drying it preferably at a temperature of 80 to 140° C., and thereafter, heat treating it preferably at a temperature of 160 to 200° C., a pad-steam method of steam heat treating it, or a bath method of elevating a temperature up to 30 to 130° C. at a condition where the knitted fabric is dipped in a treatment liquid containing a fluorine-based compound or the like can be used.

It is preferred that the degree of water repellency of the knitted fabric is rank 2 or lower and the degree of oil repellency thereof is rank 4 or higher, and by satisfying these both conditions, a soil or ointment on the skin surface does not seep outside, and does not permeate to the interiors of the fibers, and therefore, such conditions are very preferable for the clothing.

The above-described soil resistant effect is not achieved only by water repellent and oil repellent processing merely to the fibrous structure, and a high functionality is provided first by accompanying with an effect of fittability to a formation of a body surface. Namely, by providing a soil resistant function to a brassiere type inner wear while creating an appropriate close contact property to the breasts or the chest by giving the stretching effect and the fitting effect to the brassiere type inner wear by making it with the fibers having a stretchable function, as a result, high leakage prevention effect and soil resistance can be exhibited. Although a finishing agent having a functionality such as an antibacterial property or a deodorant property can be also used together, the method of providing it is not particularly restricted.

EXAMPLES

Hereinafter, although our clothing will be explained more concretely referring to Examples and Comparative Examples, this disclosure is not limited thereto. The quality evaluation of the clothing used in the Examples and Comparative Examples was carried out by the following methods.

Determination Methods (1) Elongation Rate:

The elongation rates of an outer material and a lining were determined based on "Elongation rate B method (Glove method)" of JIS-L-1096 (2010 version) "Fabric test method of woven fabric and knitted fabric".

Namely, first, five test pieces each having a width of 100 mm and a length of 150 mm were sampled in the wale direction and in the course direction, respectively. A constant-speed stretching type tensile tester equipped with an automatic recording device was used for the determination, the length of the test piece between grasps was set at 76 cm, the slack and the tension of the test piece were removed, and the test piece was fixed to grasps at a condition being applied with an initial load of 3 g. It was stretched at a tensile speed of 100 mm/min up to 14.7 N (1.5 kg), the length between the grasps at that time was measured, the elongation rate $L_A$ (%)

was determined by the following equation, and it was expressed as the average of five pieces.

$$\text{Elongation rate } L_A\ (\%)=\{(L_1-L)/L\}\times 100$$

L: length between grasps (mm)

$L_1$: length between grasps when stretched up to 14.7 N (mm)

(2) Weight Per Unit Area:

A mass per 1 $m^2$ ($g/m^2$) at a standard state is determined.

(3) Degree of Water Repellency:

It was evaluated by a spray method based on JIS-L-1092 (2009 version) "Test method for waterproof property of fibrous product", and determined by ranks. The determination by ranks was carried out at an evaluation of n=1.

(4) Degree of Oil Repellency:

The degree of oil repellency was measured based on the method defined in AATCC TM-1966, and determined by ranks. The rank was determined as an average of evaluations of n=3.

(5) Property for Removing Soil:

An artificial soil substance for dripping and wiping test method, defined in C method of JIS-L-1919 "Soil resistance test method for fibrous product" (2006 version), was dripped at an amount of 0.1 ml by a Mohr pipette from a position of 10 cm height from a back surface of a fabric. After leaving it as it is for one minute, an excessive soil substance was soaked up by softly pressing it with a standard filter paper having a diameter of 10 to 12 cm at a condition preventing spreading of the soil, and immediately thereafter, the property was determined using a grayscale for soil. At the same time, presence of seepage to the surface was determined. Thereafter, by washing it by the method of JIS-L-0217 103, easy removal property of the attached soil was determined similarly to the above-described method.

(6) Wear Feeling and Tightening Feeling:

By having a monitor wear the clothing for a patient, sensuous evaluation with texture, wear feeling and tightening feeling, dislocation property of gauze or lint, and soil resistance, was carried out. The evaluation criteria are shown in Table 1.

TABLE 1

| Determination | Texture | Wear feeling and Tightening feeling | Dislocation of gauze or lint | Soil resistance |
|---|---|---|---|---|
| 3 | Very soft and comfortable texture | Fitted to a body, Comfortable to wear | Not dislocated by close contact | Ointment or soil does not seep outside. |
| 2 | Soft and slightly comfortable texture | Slightly not fitted to a body, Uncomfortable feeling present | Slightly dislocated but can be corrected by itself | Ointment or soil slightly seeps outside. |
| 1 | Bad texture (Stiff, Sticky) | Not fitted to a body, Poor wear comfort, Tight | Dislocated and cannot be corrected | Ointment or soil seeps outside. |

Example 1

A circular knitted fabric was prepared by knitting with 28 gauges using 22T elastic threads and false twist worked threads of 56T-40F nylon yarns. After the circular knitted fabric was scoured and dyed, it was dipped in a water repellent treatment liquid mixed with ASAHIGUARD (registered trademark) AG-E100 and BECKAMINE (registered trademark) M-3 and BECKAMINE (registered trademark) ACX, squeezed by mangles, and dried at 130° C. and heat treated at 170° C.

The elongation rates of the knitted fabric were 164% in the longitudinal direction and 182% in the lateral direction, and the weight per unit area was 110 $g/m^2$. Using the circular knitted fabric, a brassiere type inner wear was made wherein a front body part having a shape covering the breasts and a back body part were sewn at a shoulder part and armpit parts, left and right parts were separated at the front center line, and woven tapes each having a width of 2 cm and attached with plastic dot buttons at the end portions were sewn thereto. Pockets capable of being put in and out of with pads were sewn with same raw materials as those of the body parts outside the position of the breasts of the inner wear, and an under belt having a width of 8 cm was sewn at same raw material as that of the body parts to each lower edge of the front body part and the back body part. On the other hand, the front center part of a cardigan was also separated to left and right parts, and to each end portion thereof, a woven tape attached with dot buttons was sewn. Further, a tape capable of being opened/closed with the tip was sewn to the shoulder line of the cardigan so that the brassiere type inner wear could be detached.

The brassiere was worn by one patient during treatment of breast cancer (mastectomy of one of the breasts), and a gel pad was inserted from the surface side to bring it into close contact with the body. Lint applied on an ointment as a treatment medicine was not dislocated down, even if it was worn all the day, a tightening feeling was not caused, the ointment was not seeped outside the cardigan, and it was excellent in wear comfort. The result of determination of the properties of the sewn product is shown in Table 2, and the result of evaluation of the texture, wear feeling, tightening feeling, dislocation of lint and soil resistance when the sewn product was worn is shown in Table 3.

Example 2

Foot cover 9 covering from the heel to the tiptoe, as shown in FIGS. 3 and 4, was sewn using the circular knitted fabric prepared in Example 1. A cushion material 11 prepared by wrapping a low repulsion material with the same circular knitted fabric as that for the body side was sewn to each of the heel and tiptoe sides on the bottom surface 10 of the foot cover 9. It was finished by passing a rubber around the ankle part so as not to be dislocated down.

When the foot cover was worn by one patient having a skin inflammation, a gauze stuck on an ointment applied to the toe or the sole of the foot was not dislocated, even if it was worn all the day, a tightening feeling was not caused, and it was excellent in wear comfort. The result of determination of the properties of the sewn product is shown in Table 2, and the result of evaluation of the texture, wear feeling, tightening feeling, dislocation of gauze and soil resistance when the sewn product was worn is shown in Table 3.

Example 3

Stomach band 12 as shown in FIG. 5 was obtained by cutting the circular knitted fabric prepared in Example 1 at a sheet having a width of 60 cm and a length of 50 cm, stacking two sheets along their width directions and sewing them to each other in a overlock manner. When the stomach band was worn by one patient suffering from a digestive disease so that the overlock seam 13 was located outside the body, the texture was good, lint stuck on an ointment applied to the abdomen was not dislocated, and because there was no seepage outside, it was excellent in wear comfort. Further, it was also good evaluation to be able to fold the stomach band at a required length or rearrange it depending upon patients. The result of determination of the properties of the sewn product is shown in Table 2, and the result of evaluation of the texture, wear feeling, tightening feeling, dislocation of lint and soil resistance when the sewn product was worn is shown in Table 3.

Example 4

Five finger gloves each covering from the fingertips to a 10 cm length part on the wrist were sewn using the circular knitted fabric prepared in Example 1. A flat rubber was provided around the wrist to prevent dislocation. When the gloves were worn by one patient having a skin inflammation, a gauze stuck on an ointment applied to the palm of the hand was not dislocated, even if they were worn all the day, an uncomfortable feeling was not caused, and it was excellent in wear comfort. The result of determination of the properties of the sewn product is shown in Table 2, and the result of evaluation of the texture, wear feeling, tightening feeling, dislocation of gauze and soil resistance when the sewn product was worn is shown in Table 3.

Example 5

A circular knitted fabric was prepared by knitting with 26 gauges using combined filament yarns of 56T polyester threads and 56T polytetramethylene terephthalate (PTT) threads. After the circular knitted fabric was scoured and dyed, it was squeezed by mangles and spread, and dried at 130° C.

The elongation rates of the knitted fabric were 161% in the longitudinal direction and 170% in the lateral direction, and the weight per unit area was 148 g/m$^2$. Using the circular knitted fabric, a brassiere type inner wear having a shape in which the front body part having a shape covering the breasts and the back body part were continuously connected, and a cardigan were knitted. In any of them, left and right parts were separated at the front center line, and plastic dot buttons were attached to the end portions. Pockets capable of being put in and out of with pads were sewn with same raw materials as those of the body parts outside the position of the breasts of the inner wear, and an under belt having a width of 6 cm was sewn to each lower edge of the front body part and the back body part. Further, a belt loop capable of being opened and closed was sewn to the shoulder line of the cardigan, and the shoulder of the brassiere type inner wear was integrated by being passed through the belt loop. When the brassiere was worn by a patient during treatment of breast cancer, the brassiere came into close contact with the body, lint applied on an ointment at an affected part was not dislocated down, even if it was worn all the day, a tightening feeling was not caused, and it was excellent in wear comfort. Further, because of presence of the cardigan, it was not shameful even if the patient was walking in a hospital. The result of determination of the properties of the sewn product is shown in Table 2, and the result of evaluation of the texture, wear feeling, tightening feeling, dislocation of lint and soil resistance when the sewn product was worn is shown in Table 3.

Example 6

The brassiere type inner wears prepared in Example 1 were worn by 30 patients suffering from breast cancers and receiving radiation therapy under management of doctors, from a time started with the radiation therapy through a time over one month after fishing the radiation therapy, and the wear feeling and the functions of the brassiere were evaluated. With respect to the patients for the evaluation, they suffered from primary breast cancer being performed with radiation therapy to the chest walls and the radiation therapy was regardless of irradiation after operation or palliative irradiation, and their ages were from 34 to 78 years and the average age was 52 years. The sizes of the brassieres were prepared at three kinds of S, M and L by 10 brassieres for each size, and those were worn depending upon body figure and size of chest.

As the result is shown in Table 4, extremely high evaluation results could be obtained over all the evaluation items, and satisfactions of the patients were very high. The patients participating in the wearing test usually use general brassieres, but for the term for radiation therapy they could not be used because of causing radiodermatitis, and if our brassiere type inner wear was not present, they were in a condition where an appropriate under wear could not be utilized. Therefore, our brassiere type inner wear has not only superiority in function as compared to a general brassiere, but also a significance as a complementary inner wear at the time of radiation treatment.

Comparative Example 1

A circular knitted fabric was prepared by knitting with 32 gauges using yarns covering 310T elastic threads with 44T nylon threads. After the circular knitted fabric was scoured and dyed, it was squeezed by mangles and dried at 120° C. The elongation rates of the knitted fabric were 152% in the longitudinal direction and 129% in the lateral direction, and the weight per unit area was 220 g/m$^2$. Using the circular knitted fabric, a brassiere type inner wear which had a shape, in which the front body part having a shape covering the breasts and the back body part were continuously connected, and which was a type being worn from the head without being separated at a front center line, was obtained. Pockets capable of being put in and out of with pads were sewn with same raw materials as those of the body parts outside the position of the breasts of the inner wear, and a flat rubber belt having a width of 2 cm was sewn to each lower edge of the front body part and the back body part. When the brassiere was worn by one patient during treatment of breast cancer, because the brassiere did not come into close contact with the body, lint applied on an ointment was dislocated, and a soil and the ointment seeped up to a blouse worn thereon. Further, because an under belt was the flat rubber belt having a width of 2 cm, only the under belt was tightened, and on the skin therearound, an itching was caused. The result of determination of the properties of the sewn product is shown in Table 2, and the result of evaluation of the texture, wear feeling, tightening feeling, dislocation of lint and soil resistance when the sewn product was worn is shown in Table 3.

Comparative Example 2

A circular knitted fabric was prepared by knitting with 16 gauges using spun yarns mixed with acrylic 38%, rayon 21% and polyester 41%. After the circular knitted fabric was scoured and dyed, it was squeezed by mangles and dried at 120° C. The elongation rates of the knitted fabric were 88% in the longitudinal direction and 118% in the lateral direction, and the weight per unit area was 156 g/m$^2$. Using the circular knitted fabric, a tank top was knitted, cup parts used with a urethane foam inside them and a marquisette as a base cloth were sewn to each other, a flat rubber belt having a width of 1 cm was sewn around the bottom thereof, and it was sewn to the upper edge part of the chest of the tank top. When the inner wear was worn by one patient during treatment of breast cancer, because the cups of the urethane foam did not follow the breasts, although an ointment for treatment was applied to the breasts and the cups were held by a lint, they were dislocated and a pain was caused by the flat rubber belt around the bottom put into the body. The result of determination of the properties of the sewn product is shown in Table 2, and the result of evaluation of the texture, wear feeling, tightening feeling, dislocation of lint and soil resistance when the sewn product was worn is shown in Table 3.

TABLE 2

| | Kind of wear | Mixture ratio (%) | Properties: Elongation rate (%) Longitudinal | Elongation rate (%) Lateral | Weight per unit area ($g/m^2$) | Thickness (mm) |
|---|---|---|---|---|---|---|
| Example 1 | Cardigan + Brassiere | Polyurethane 12 Nylon 88 | 164 | 182 | 98 | 0.6 |
| Example 2 | Foot cover | Polyurethane 12 Nylon 88 | 164 | 182 | 98 | 0.6 |
| Example 3 | Stomach band | Polyurethane 12 Nylon 88 | 164 | 182 | 98 | 0.6 |
| Example 4 | Gloves | Polyurethane 12 Nylon 88 | 164 | 182 | 98 | 0.6 |
| Example 5 | Cardigan + Brassiere | Polyester 100 (T50PTT50) | 161 | 170 | 148 | 0.78 |
| Example 6 | Brassiere | Polyurethane 12 Nylon 88 | 164 | 182 | 98 | 0.6 |
| Comparative Example 1 | Brassiere | Nylon 80 Polyurethane 20 | 152 | 129 | 220 | 1.02 |
| Comparative Example 2 | Tank top with cup | Acrylic 38 Rayon 21 Polyester 41 | 88 | 118 | 156 | 0.67 |
| Comparative Example 3 | Tank top | Cotton 100 | 32 | 55 | 210 | 0.98 |

TABLE 3

| | Texture | Wear feeling and Tightening feeling | Dislocation of gauze or lint | Soil resistance | Total evaluation |
|---|---|---|---|---|---|
| Example 1 | 3 | 3 | 3 | 3 | 12 |
| Example 2 | 3 | 3 | 3 | 3 | 12 |
| Example 3 | 3 | 3 | 3 | 3 | 12 |
| Example 4 | 3 | 3 | 3 | 3 | 12 |
| Example 5 | 3 | 3 | 3 | 1 | 10 |
| Comparative Example 1 | 2 | 1 | 1 | 1 | 5 |
| Comparative Example 2 | 2 | 1 | 1 | 1 | 5 |
| Comparative Example 3 | 1 | 1 | 1 | 1 | 4 |

Comparative Example 3

A circular knitted fabric was prepared by knitting with 16 gauges using No. 30 count cotton 100% spun yarns. After the circular knitted fabric was scoured and dyed, it was squeezed by mangles and dried. The elongation rates of the knitted fabric were 32% in the longitudinal direction and 55% in the lateral direction, and the weight per unit area was 210 $g/m^2$. Using the circular knitted fabric, a tank top was knitted. When the inner wear was worn by one patient having a skin inflammation on the chest at a condition where lint was wound on the body at a position of an ointment applied as a treatment medication and thereon the inner wear was worn, the lint could not be fixed, it was dislocated down as the time passed, and a soil seeped out on the tank top. The result of determination of the properties of the sewn product is shown in Table 2, and the result of evaluation of the texture, wear feeling, tightening feeling, dislocation of lint and soil resistance when the sewn product was worn is shown in Table 3.

To the breast cancer patients and the chest skin inflammation patient performing the evaluations of Examples 1 and 5 and Comparative Examples 1 to 3, it was requested to evaluate each clothing at the same criteria independently from each other, thereby keeping the reliability of mutual comparison of the respective evaluation results.

TABLE 4

| Item of evaluation | Very good | Good/ relatively good | Not good | Evaluation uncertain |
|---|---|---|---|---|
| Size | 23/30 (77%) | 6/30 (20%) | 0/30 (0%) | 1/30 (3%) |
| Comfort to wear | 25/30 (83%) | 4/30 (13%) | 0/30 (0%) | 1/30 (3%) |
| Comfort · Texture | 27/30 (90%) | 2/30 (7%) | 0/30 (0%) | 1/30 (3%) |
| Protection of affected part | 26/30 (87%) | 3/30 (10%) | 0/30 (0%) | 1/30 (3%) |
| Holding of external preparation | 20/30 (67%) | 9/30 (30%) | 0/30 (0%) | 1/30 (3%) |

INDUSTRIAL APPLICABILITY

Our clothing can be applied to any clothing required with comfortable texture and excellent wear comfort, in particular, it is suitable as clothing used by a patient having skin inflammations.

The invention claimed is:

1. A garment made from a knitted fabric made from a composite thread of elastic fibers and synthetic fibers, including:

a front opening brassiere comprising a front body part and a back body part, wherein the front body part includes a left and right breast portions that are adapted to fasten together by an engagement member, and an under belt located under a position of the breast portions of said front opening brassiere, a width of said under belt is 5 cm to 10 cm, wherein knitted fabric has elongation rates in longitudinal and lateral directions of said knitted fabric as measured in accordance with the grab method of JIS-L-1096 and under a 1.5 kg load are at least 160% and less than 250%, and a weight per unit area of said knitted fabric is at least 90 $g/m^2$ and less than 160 $g/m^2$.

2. The garment according to claim 1, wherein said synthetic fibers comprise polyamide-based fibers having a moisture absorption.

3. The garment according to claim 1, wherein the left and right breast portions include pockets configured to receive pads.

4. The garment according to claim 1, wherein said garment further includes a front opening cardigan.

5. The garment according to claim 4, wherein said front opening cardigan and said front opening brassiere are removably attached from each other at a shoulder line.

6. The garment according to claim 1, wherein said knitted fabric is treated by water repellent finishing.

7. The garment according to claim 6, wherein a fluorine-based compound is provided on surfaces of fibers of said knitted fabric.

8. The garment according to claim 7, wherein said fluorine-based compound is a fluorine-based water repellent and oil repellent resin having a hydrophilic component.

9. The garment according to claim 8, wherein said knitted fabric is rank 2 or lower in degree of water repellency and rank 4 or higher in degree of oil repellency.

10. The garment according to claim 1, wherein said knitted fabric has an antibacterial property.

11. The garment according to claim 1, wherein said knitted fabric has a deodorant property.

12. The garment according to claim 1, wherein said garment clothing is adapted to be used by a patient having a skin inflammation on their chest.

* * * * *